US009163419B2

(12) United States Patent
Pendley

(10) Patent No.: US 9,163,419 B2
(45) Date of Patent: Oct. 20, 2015

(54) BAND HARDNESS IN FALL PROTECTION SYSTEM

(71) Applicant: Timothy Pendley, Madera, CA (US)

(72) Inventor: Timothy Pendley, Madera, CA (US)

(73) Assignee: MATE, LLC, Green Bay, WI (US)

( * ) Notice: Subject to any disclaimer, the term of this patent is extended or adjusted under 35 U.S.C. 154(b) by 0 days.

(21) Appl. No.: 14/203,913

(22) Filed: Mar. 11, 2014

(65) Prior Publication Data

US 2015/0259937 A1 Sep. 17, 2015

(51) Int. Cl.

| | |
|---|---|
| ***E04G 21/32*** | (2006.01) |
| ***E04D 13/16*** | (2006.01) |
| ***E04B 7/02*** | (2006.01) |

(52) U.S. Cl.

CPC ..... *E04G 21/3214* (2013.01); *E04B 7/024* (2013.01); *E04D 13/1625* (2013.01); *E04G 21/3204* (2013.01); *E04G 21/3266* (2013.01)

(58) Field of Classification Search

CPC ..... E04D 13/1625; E04G 21/3204; E04G 21/3214; E04G 21/3266; E04G 21/3261; E04B 7/024

USPC ..... 52/749.12, 664; 182/137, 138

See application file for complete search history.

(56) References Cited

U.S. PATENT DOCUMENTS

| | | | | |
|---|---|---|---|---|
| 4,446,664 | A * | 5/1984 | Harkins | 52/404.3 |
| 4,573,298 | A * | 3/1986 | Harkins | 52/404.3 |
| 4,875,320 | A * | 10/1989 | Sparkes | 52/406.1 |
| 5,201,152 | A | 4/1993 | Heffner | |
| 5,251,415 | A | 10/1993 | Van Auken et al. | |
| 5,406,764 | A | 4/1995 | Van Auken et al. | |
| 5,901,518 | A | 5/1999 | Harkins | |
| 5,953,875 | A | 9/1999 | Harkins | |
| 6,226,945 | B1 | 5/2001 | Henry et al. | |
| 6,247,277 | B1 | 6/2001 | Kerpash, Sr. | |
| 6,401,426 | B1 | 6/2002 | Alderman et al. | |
| 6,748,715 | B1 | 6/2004 | Black et al. | |
| 8,590,245 | B2 * | 11/2013 | Peng et al. | 52/407.4 |
| 2002/0020584 | A1 * | 2/2002 | Cjepa | 182/138 |
| 2003/0114055 | A1 * | 6/2003 | Burton et al. | 442/31 |
| 2011/0067345 | A1 * | 3/2011 | Crostic et al. | 52/698 |
| 2013/0108377 | A1 | 5/2013 | Steffenino | |

FOREIGN PATENT DOCUMENTS

WO 2012/145783 A1 * 11/2012

OTHER PUBLICATIONS

Publication GLS083-002-Energy Saver, ESFP, 20 pages, Jul. 2014.*

(Continued)

*Primary Examiner* — Robert Canfield

(74) *Attorney, Agent, or Firm* — Thomas D. Wilhelm; Wilhelm Law, S.C.

(57) ABSTRACT

This invention provides fall protection systems, in metal building construction, and methods of installing such systems. A given such system comprises a suspension fabric, supported by a grid-work of longitudinal and lateral support bands. At least one of the lateral support bands is a relatively softer steel having greater elongation properties, while having lower yield and tensile strengths. The balanced properties better distribute the force of a falling object to the respective members of the fall protection system so as to limit the force which must be tolerated by the suspension fabric, such that the system can catch and hold a dropped test load, or a worker falling onto such system, without catastrophic failure of the suspension fabric.

23 Claims, 6 Drawing Sheets

(56) References Cited

OTHER PUBLICATIONS

Publication GLS065, 2 pages, Genreal Description and Product Specifications of the Guardian ES systems, Mar. 2011.*
2 pages, Typical Mechanical Properties for Steel Sheets, Harris Steel, found onlne Feb. 2015.*
Guardian Energy Saver FP, printed from internet Aug. 4, 2014, 23 pages.
Guardian Building Products Distribution, Inc., Guardian ES Energy Saver FP, Product Specification Sheet, Copyright 2011, 2 pages, Guardian Building Products, Greer, South Carolina.
Steelscape, A Bluescope Steel Company, Zincalume Steel Grade 50 (Class 1), Grade Data Sheet, Jul. 1, 2012, 1 page, Steelscape.
Steelscape, A Bluescope Steel Company, Zincalume Steel Grade 80 (Class 1), Grade Data Sheet, Jul. 1, 2012, 1 page, Steelscape.
Maple Leaf Sales, K-Grip 514 Flammable Foam, Product Data Sheet, received Feb. 3, 2014, 1 page.
Maple Leaf Sales II, Inc., 514 Macroplast Adhesive, Material Safety Data Sheet, dated Jul. 16, 2010, 3 pages.

* cited by examiner

BAND HARDNESS IN FALL PROTECTION SYSTEM

BACKGROUND OF THE INVENTION

This invention relates to buildings, building components, building subassemblies, and building assemblies, and to methods of constructing buildings. This invention relates specifically to components, subassemblies, and assemblies, as parts of the building, and to the issue of worker safety during the construction of buildings.

From time to time, injuries occur during construction of buildings, including to workers who fall from elevated heights. The focus of this invention is to enable a building contractor to reduce, desirably to eliminate, the number of incidents of worker injuries resulting from workers falling from elevated heights while working on construction of the building.

Governmental safety organizations, for example the Occupational Safety and Health Administration (OSHA) in the US, have promulgated required safety standards, and safety practices to generally provide safety systems which capture and support workers who are working at substantial heights above supporting surfaces, to protect such workers, namely to stop a fall, and to support such workers if/when such workers do fall. But it is up to the industry to create fall protection systems which meet the required standards.

Pre-engineered metal building systems are the predominant method of non-residential low rise construction for buildings. Existing fall protection standards have substantial impact on the contractors involved in such pre-engineered metal building systems.

One way a worker can be protected, according to the standards, is for the worker to wear a safety harness which is tied, by a strap, to the building structure at elevation such that the harness/strap combination stops any fall which the worker experiences before the worker encounters an underlying surface such as a floor or the ground. Use of such safety harness is known as "tying off". But tying the harness to the building limits the worker's mobility, as well as the worker's range of movement. Thus, tie-off harnesses are not viewed favorably in the industry because of worker inefficiency.

Another way workers can be protected is for the building contractor to erect safety nets in order to provide leading edge protection against falls. Cost and maintenance of such safety nets, as well as the equipment and expense required for erecting and dismantling the net and associated equipment, and moving and storing the net and equipment, can be a substantial increment in the per square foot cost of especially the roof insulation system being installed.

With the anticipation of expanded enforcement efforts by government safety officials, building erectors have increased incentive to find ways to meet the existing fall protection requirements.

Another acceptable fall protection system is a passive system wherein a fabric, such as a solid sheet, a woven sheet, or a net-like material, is suspended at or below the work area, optionally supported by a grid of crossing support bands, far enough above any underlying supporting surface to catch and support a worker who falls, thereby to act as a passive fall-protection system.

OSHA has defined a drop test procedure whereby a such passive fall protection system can be tested. According to the test procedure, a 400 pound weight is dropped onto the fall protection system under stated conditions to determine whether a given system meets the required safety standards. For purposes of complying with government regulations, any system used as a fall protection system need only meet the OSHA-mandated standards related to dropping such 400 pound weight. Of course, the real humanitarian objective is to prevent worker injuries if/when a worker falls from an elevated work location. Thus, any fall protection system which is effective to catch and safely hold a falling worker has operational value, even if such system does not meet OSHA standards.

According to one aspect of the prior art, currently in use in the metal building industry, and intended to meet government fall protection standards, a purported fall protection system uses crossing longitudinal and lateral metal bands extending under the cave, under the ridge, and under the intermediate purlins, and a fabric is installed above the bands and under the purlins, extending across the entirety of a respective bay of the building being constructed, thereby providing a suspended fabric intended to catch and support a falling worker in that bay. Insulation is ultimately installed on the top surface of the fabric whereby the fabric ultimately functions as the vapor barrier portion of the building ceiling insulation system in the finished building.

Testing has shown that currently-available such systems meet the government-mandated drop test standard at certain locations in the bay of a metal building under construction, while failing such drop test at other locations. Typically, such systems fail the drop test adjacent an edge of the bay, where any worker accidental fall is most likely to occur. Thus, the user cannot be assured that a falling worker will be caught and supported at whatever location he/she falls from the elevated work location. Such failure can result in worker injury, along with the numerous detrimental results of such injury, as well as resulting government citations associated with the resulting injury, and associated monetary fines and/or assessments, civil lawsuits, and the like.

Accordingly, there is a need for a novel passive fall protection system for use during construction of metal buildings which effectively catches and supports a falling worker working at an elevated height anywhere in the corresponding bay being worked on, and which system meets all governmental safety standards.

There is also a need to provide a portion of a building insulation system which functions to provide effective fall protection during construction of the building, while meeting the existing governmental fall protection requirements.

These and other needs are alleviated, or at least attenuated, or partially or completely satisfied, by novel products, systems, and/or methods of the invention.

SUMMARY OF THE INVENTION

This invention provides fall protection systems comprising a suspension fabric, supported by a grid-work of longitudinal and lateral support bands, used to protect workers working at heights against falls onto underlying support surfaces, during construction of such metal buildings. The fall protection system provides relatively softer, more extensible, support bands. The system, using the softer support bands, dissipates an increased fraction of the force imposed on the suspension fabric, by the falling object, in such softer support bands as the bands experience a higher level of permanent deformation, by elongation, as such bands receive the impact force and as the bands distribute a remainder portion of the impact force of such falling load to the roof structural members, of the building, resulting in enhanced capacity for the fall protection system to catch and hold falling loads.

In a first family of embodiments, the invention comprehends a fall protection system in a building roof structure, for protecting workers involved in installation of the roof structure, the building roof structure including structural roof elements which include at least first and second rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the cave and the ridge, the cave and the ridge being disposed on, extending transverse to, and being connected to, the tops of the first and second rafters, and a plurality of intermediate purlins extending between the first and second rafters and spaced from each other between the cave and the ridge, the intermediate purlins being disposed on, and extending transverse to, the tops of the first and second rafters, the fall protection system comprising a first set of longitudinal support bands extending from the first rafter to the second rafter and being connected to the building structural roof elements, the first set of longitudinal support bands being spaced along the lengths of the first and second rafters; a second set of lateral support bands extending from the cave toward the ridge and under the intermediate purlins, the bands of the second set of support bands having first and second end portions which are spaced along the lengths of the cave and the ridge; and a suspension fabric overlying, and being supported by, the first and second sets of support bands, and being attached to the building structural roof elements, the first and second sets of support bands collectively defining a grid-work of crossing bands, a first band of the second set of lateral support bands next adjacent the first rafter, having at least one of (i) yield strength of 45 ksi to 85 ksi, or (ii) a tensile strength of 60 ksi to 90 ksi, or (iii) an elongation of 12 percent to 40 percent.

In some embodiments, the first band has at least one of (i) a yield strength of 45 ksi to 75 ksi, or a tensile strength of 65 ksi to 85 ksi, or (iii) an elongation of 22 percent to 37 percent.

In some embodiments, the first band has (i) a yield strength of 45 ksi to 75 ksi, and (ii) a tensile strength of 65 ksi to 85 ksi, and (iii) an elongation of 22 percent to 37 percent, and (iv) Rockwell B hardness of 64 to 79.

In same embodiments, the first band has a hardness of 50 Rockwell B to 85 Rockwell B, optionally 55 Rockwell B to 80 Rockwell B, optionally 64 Rockwell B to 79 Rockwell B.

In some embodiments, the first band comprises a safety band, the band grid comprising a such safety band next adjacent each side of each rafter in any portion of the building roof structure where the band grid supports the suspension fabric.

In some embodiments, the suspension fabric extends, as a generally flat sheet, across an open expanse bounded by the first rafter, the ridge, the second rafter, and the eave, the suspension fabric being supported by the first and second sets of bands and being restrained against movement along the structural roof elements by attachments of the suspension fabric to the first and second rafters, to the eave proximate a first end of the suspension fabric and to another one of the structural roof elements proximate a second opposing end of the suspension fabric.

In some embodiments, the fall protection system is of sufficient strength to catch and support a weight of 400 pounds, distributed over a diameter of approximately 30 inches, when dropped from a height of about 50.5 inches.

In some embodiments, each of the lateral support bands has (i) a yield strength of 45 ksi to 75 ksi, and (ii) a tensile strength of 65 ksi to 85 ksi, and (iii) an elongation of 22 percent to 37 percent, and (iv) Rockwell B hardness of 64 to 79.

In some embodiments, each of the lateral support bands and each of the longitudinal support bands has (i) a yield strength of 45 ksi to 75 ksi, and (ii) a tensile strength of 65 ksi to 85 ksi, and (iii) an elongation of 22 percent to 37 percent, and (iv) Rockwell B hardness of 64 to 79.

BRIEF DESCRIPTION OF THE DRAWINGS

Illustrative embodiments of the invention are described hereinafter, by way of example only, with reference to the accompanying drawings, wherein.

Figure 1:
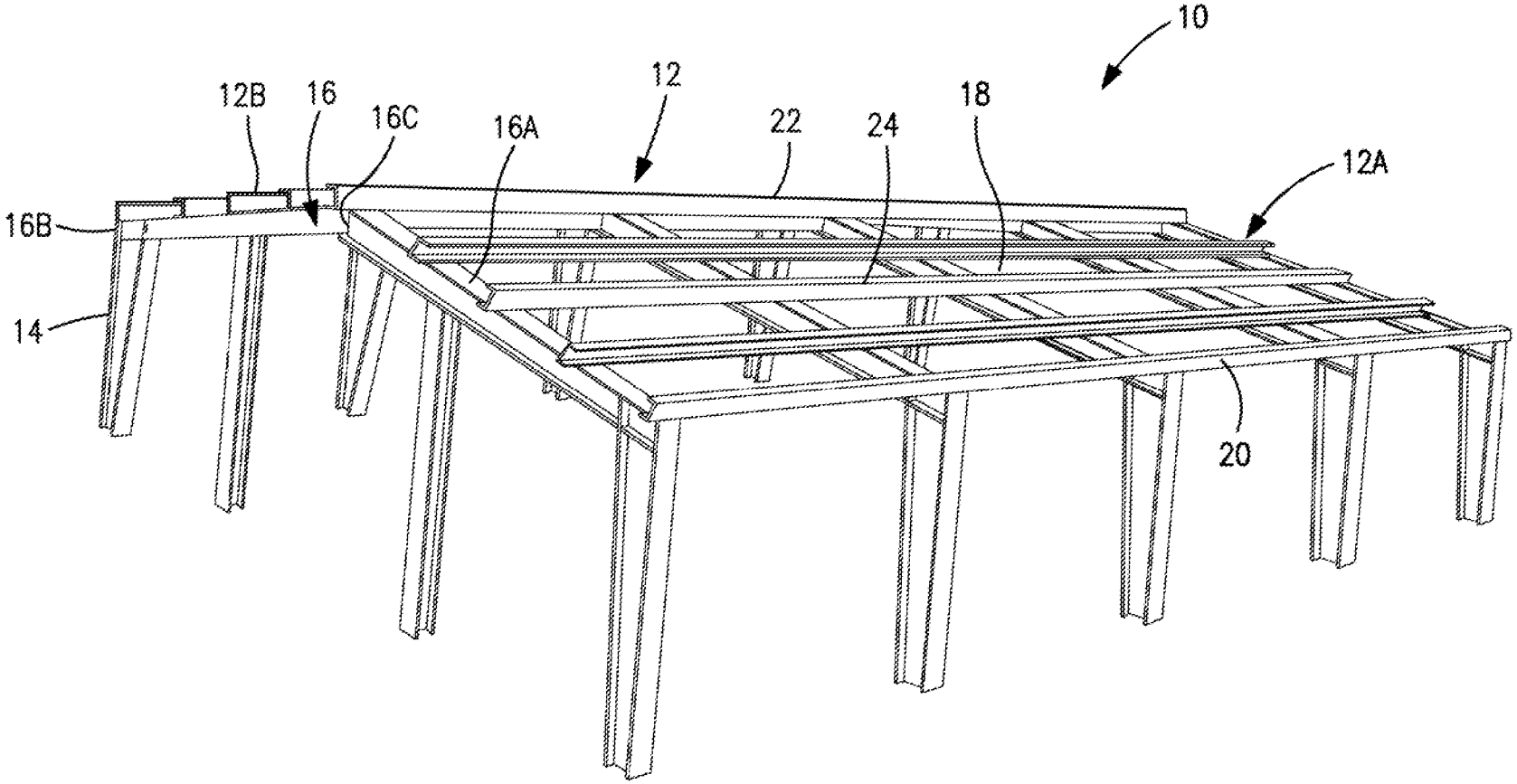
FIG. 1 is a perspective view, from above the eaves, of a typical metal building structure, including columns, rafters, eaves, ridges, and intermediate purlins.

The invention is not limited in its application to the details of construction, or to the arrangement of the components, or to the methods of construction, set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIG. 1 illustrates the primary structural members of a typical metal building 10 having first and second roof slopes 12A and 12B. Vertical support for the structural elements of the roof, designated generally as 12, is provided by upstanding columns 14 positioned along side walls and end walls of the building. Rafters 16 overlie the tops of the columns and are supported by the columns. Rafters 16 span the width of the building, creating a series of open spaces between rafters 16, the open spaces being commonly referred to as "bays" 18 in the construction arts, the bays representing distances between respective ones of the rafters. Each rafter has an upper surface 16A, and opposing first 16B and second 16C ends.

According to the embodiments illustrated in FIGS. 1-4, eaves 20, expressing "C"-shaped cross-sections, are positioned at the down-slope ends of the rafters 16. Lengths of the eaves extend along the length of the building, above the outer wall of the building. The eaves provide lateral support to the skeletal structure of the building between respective ones of the columns 14, at the outer building wall. A given cave extends between the first ends 16B of respective ones of the rafters.

Figure 4:
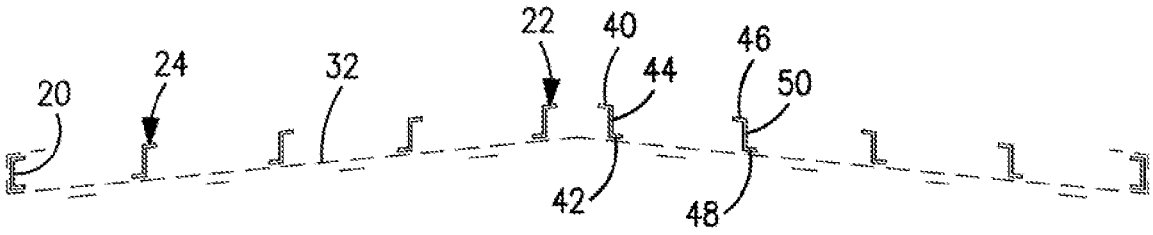
FIG. 4 is a diagrammatic end view of a roof structure of a metal building, showing longitudinal band spacing with respect to the eaves, the ridges, and the intermediate purlins.

Ridge members 22, expressing "Z"-shaped cross-sections as illustrated in FIG. 4, have lengths which overlie, and are attached to, the upper surfaces of rafters 16. The ridge members are positioned at the up-slope ends of the rafters, and run the length of the building parallel to the eaves, typically above the central portion of the building. The ridge members provide lateral support to the skeletal structure of the building between respective ones of rafters 16, typically at an internal portion of the building, away from the building side walls in the illustrated embodiments. A given ridge member extends between the second ends 16C of the respective ones of the rafters. Where the roof has a single pitch direction, the ridge can be positioned proximate one of the outer walls of the building.

The ridge members and the eave members overlie, extend transverse to, and are attached to, the upper surfaces of the respective rafters 16, and are spaced from each other by distances which generally correspond to the lengths of the respective rafters between ends 16B and 16C.

Intermediate purlins 24 express "Z"-shaped cross-sections. The intermediate purlins overlie, extend transverse to, and are attached to, upper surfaces 16A of the respective rafters. Purlins 24 are spaced from each other along the lengths of the rafters. The purlins extend parallel to each other and parallel to any ridges and eaves and, overall, span the length of the bay, whereby the purlins are displaced from each other and from any ridges and eaves along the spaces between the respective eave and the ridge.

Figure 2:
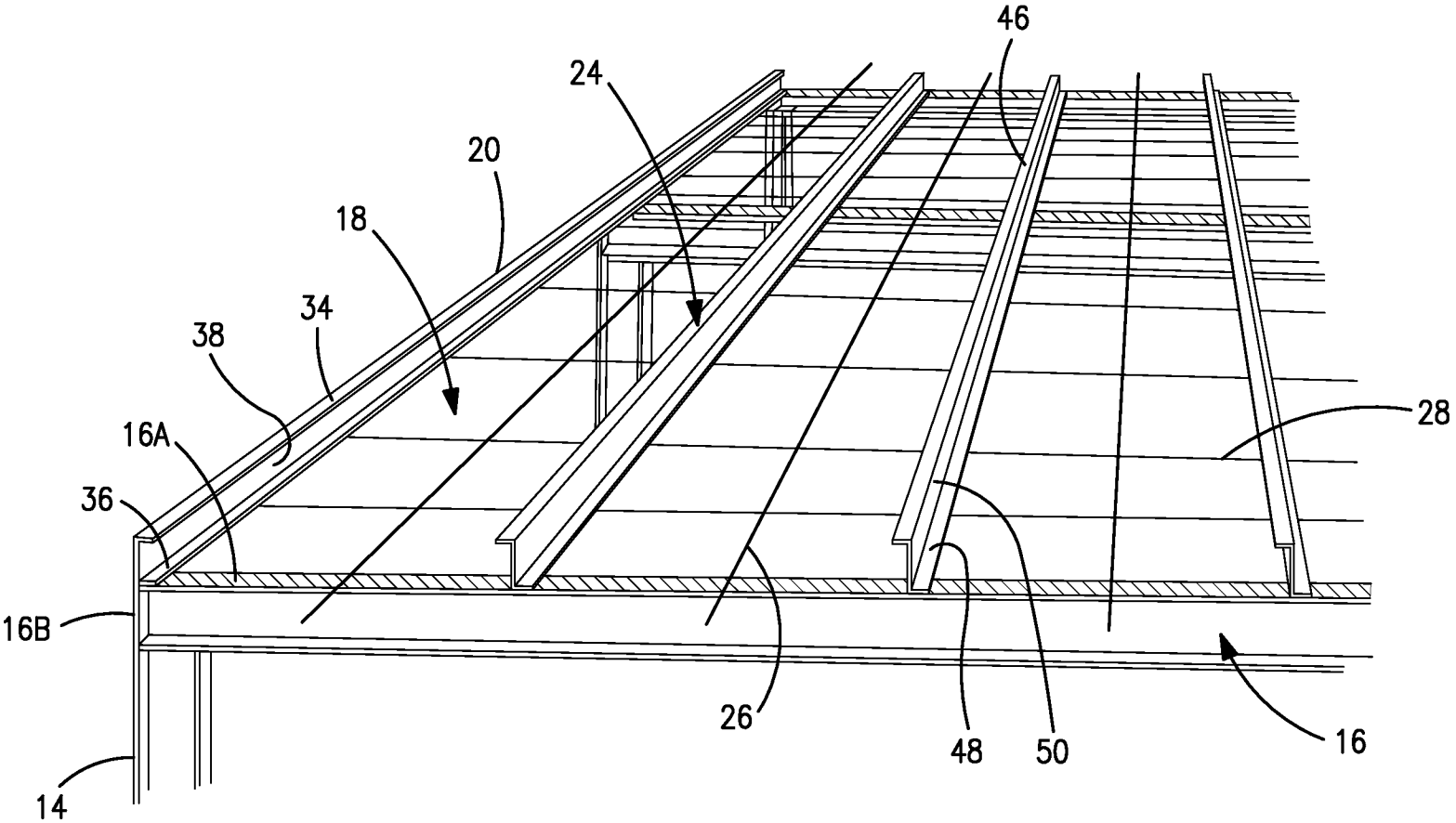
FIG. 2 is a perspective view, from above the roof, of part of a bay of a metal building, showing columns, rafters, purlins, an eave, and a grid-work of crossing bands.

As shown in FIG. 2, the fail protection support system, namely the suspension system, of this invention includes a supporting grid-work formed by crossing elongate steel bands, including longitudinal support bands 26 and lateral support bands 28. Support bands 26, 28 of the grid-work are supported by various ones of the building structural members, as described herein, and the collective grid-work generally defines an imaginary plane, extending into the sheet of the drawing illustrated in FIG. 4. Such imaginary plane extends parallel to a set of imaginary straight lines, spaced from each other and extending between the lower surfaces of the eaves 20, the ridge 22, and intermediate purlins 24, and further extending parallel to imaginary straight lines which connect the upper surfaces of the rafters.

Figure 3:
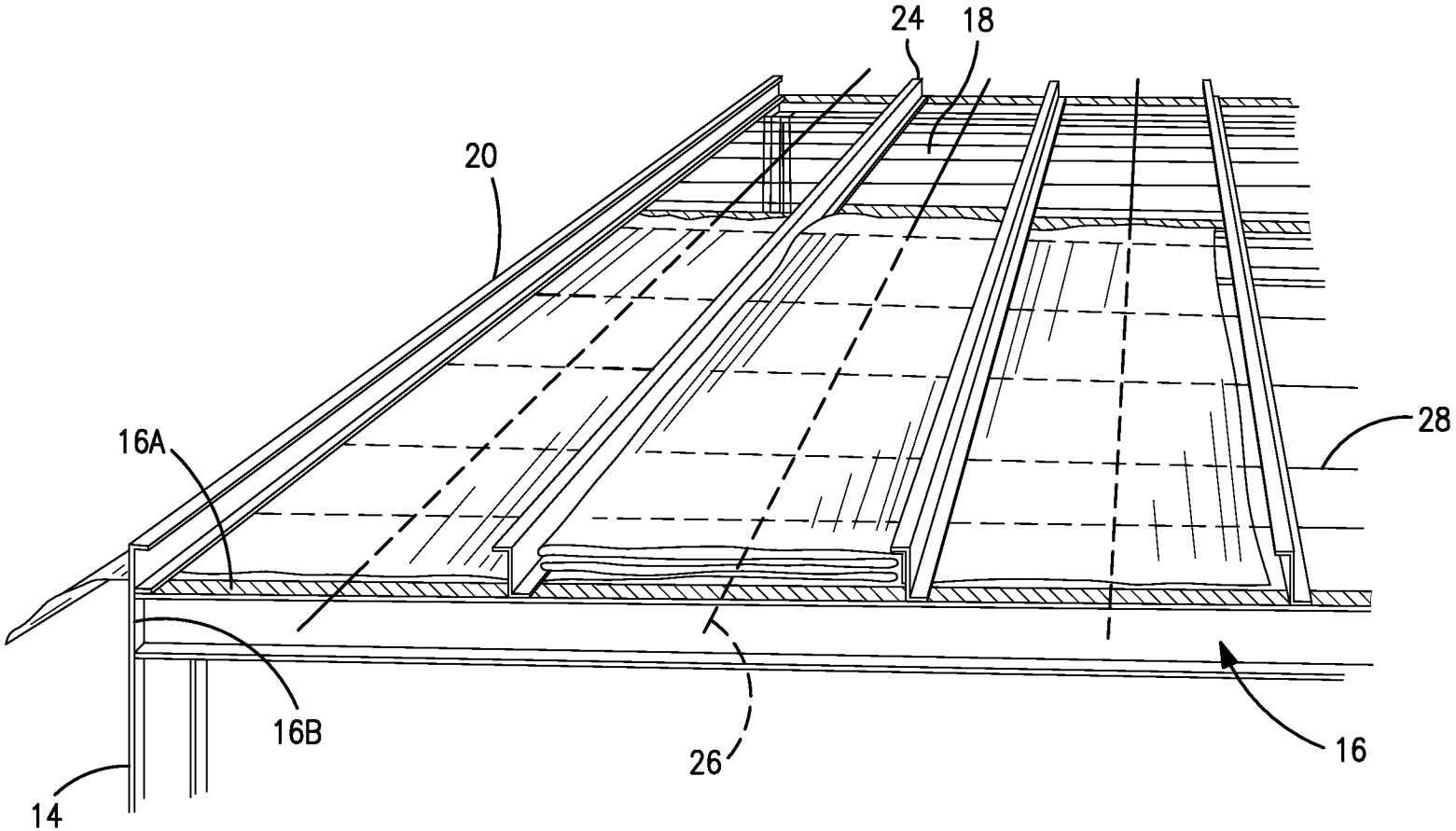
FIG. 3 is a perspective view as in FIG. 2 showing a suspension fabric partially extended over the band grid-work and under the eave and under the purlins, in a single bay.

Support bands 26, 28 support a high strength fabric 32, the fabric being shown partially unfolded in FIG. 3 and, in FIG. 4, the fabric is suggested by the dashed line under the eave, ridge, and intermediate purlins, and above longitudinal bands 26, bands 26 being shown in FIG. 4 in end view. Fabric 32 in the illustrated embodiments also serves as a vapor barrier for the insulation system which is ultimately installed at the roof of the building.

Starting with the structural skeleton of the building as illustrated in FIG. 1, a fall protection system of the invention is installed generally as follows. Longitudinal metal bands 26 are extended from the upper surface of a first one of the rafters to the upper surface of a second one of the rafters at angles which are typically, but not necessarily, perpendicular to the respective rafters. The number of longitudinal bands 26 depends to some degree on the distance between the respective ones of the intermediate purlins 24. In the invention, typically only a single longitudinal band 26 is used between each pair of next-adjacent purlins 24. However, in certain systems, which can be engineered based on the technology disclosed herein, two or more longitudinal bands may be used where such additional band use may be cost-effective and/or when use of such additional band may be needed in order to satisfy the respective governmental standard. Of course, the greater the number of bands used, the greater the cost of the band system. Accordingly, the user is motivated to have the system engineered so as to use as few of such longitudinal bands as possible while meeting the required safety standards.

A length of a given longitudinal band 26 extends across a given bay and is extended across the upper surface of each rafter overlain by the respective band, and is attached to the upper surfaces, or other surfaces, of the respective rafters. Where the longitudinal band 26 extends across multiple bays, the longitudinal band is secured, for restrained longitudinal movement, to the upper surfaces of those rafters which are most remote from one another. Optionally, but not necessarily, the longitudinal band may be secured to one or more intermediate rafters.

Longitudinal bands 26 are fastened to the rafters or rake channels (not shown) which correspond with the end portions of the bands by conventional attachment means such as by self-drilling screws. Longitudinal bands 26 are pulled tight between the rafters so as to, in part, and at this stage of installation, begin to define the afore-mentioned band grid, and the imaginary plane of support provided by the band grid, immediately under the intermediate purlins. Band attachment tools, known in the art, may be used in attaching the bands, either temporarily or permanently, to the rafters or rake channels, thus to instill a suitable, conventionally known, level of tension in bands 26 as the bands are being installed.

Each eave has a top flange 34, a bottom flange 36, and an upstanding web 38 extending between the top and bottom flanges, and connecting the top flange to the bottom flange. The top and bottom flanges are arranged such that the profile of the eave defines a generally "C"-shaped structure, perhaps best seen in FIG. 5.

While the eave profiles shown define generally perpendicular turns between the flanges 34 and 36, and upstanding web 38, actual eave profiles typically define a modest acute angle (not shown) between the bottom flange and the upstanding web and a corresponding modest obtuse angle (not shown) between the top flange and the upstanding web. Such acute and obtuse angles adapt the eave to the specific slope of the roof for which the eaves are designed, while providing that the upstanding web conforms to the vertical orientation of the respective side wall of the building.

Correspondingly, each ridge has a top flange 40, a bottom flange 42, and an upstanding web 44 extending between the top and bottom flanges, and connecting the top flange to the bottom flange. The top and bottom flanges are arranged such that the profile of the ridge defines a "Z"-shaped structure, as illustrated in FIG. 4.

Similarly, each intermediate purlin has a top flange 46, a bottom flange 48, and an upstanding web 50 extending between the top and bottom flanges, and connecting the top flange to the bottom flange. The top and bottom flanges are arranged such that the profile of the respective purlin defines a "Z"-shaped structure, illustrated in FIGS. 4 and 6.

Lateral bands 28 are installed after the longitudinal bands 26 are in place. Lateral bands 28 extend transverse to, typically perpendicular to, the longitudinal bands. Lateral bands 28 generally underlie and support longitudinal bands 26. Lateral bands 28 may be first attached to the respective ridge 22. Bands 28 may be attached to any suitable surface of the ridge which enables the band to pass, from the location of attachment, under and in tensioned contact with, the bottom flange of the ridge. For example, a lateral band can be attached to the bottom surface of the bottom flange of the ridge, with intervening fabric 32, and extend from there toward the eave.

As an alternative, one end of a given lateral band can extend up alongside, and be fastened to, the surface of the upstanding ridge web which faces away from the eave on the respective slope of the roof. The band passes alongside, and turns about, the edge of the bottom flange of the ridge which faces away from the respective cave, and then passes under, and in general contact with, the bottom surface of the bottom flange, again with intervening fabric, and extends from there toward the cave.

As a still further example of attachment of a lateral band to the ridge, the band can be attached to the top surface of the top flange, turn about the upper edge of the top flange which is away from the respective eave, extend from there down toward the bottom ridge flange, turn about the edge of the bottom flange and pass alongside, and in general contact with, the bottom surface of the bottom flange, and extend from there toward the cave, again with the fabric between the band and the ridge.

The lateral bands are extended, from the bottom surface of the bottom flange of the ridge toward the respective cave, passing under the longitudinal bands, and pulled tight to minimize sag in both the lateral bands and the respective overlying longitudinal bands. The so-tightened lateral bands are in general contact, again with intervening fabric, with the bottom surface of the bottom flange of the respective cave. With the so-tightened lateral bands in contact with the bottom surface of the bottom flange of the respective cave, the lateral bands are fastened to the cave so as to maintain the tension in the lateral bands, thus to lift the lateral bands toward the bottom flanges of the overlying intermediate purlins.

The number of lateral bands 28 to be used between a respective pair of next-adjacent rafters, and the spacing between the lateral bands, varies with the distance between the rafters. Typically, the lateral bands are 36 inches to 40 inches apart, optionally up to 48 inches apart in some cases.

Traditional banding stock used for bands 26 and 28 is a hot-dip zinc/aluminum alloy-coated Grade 80 structural steel, 0.023 inch thick, having longitudinal tensile yield strength of at least 93 ksi, such Grade 80 banding sometimes being referred to in the industry as "full hard". Such steel banding is typically about 1 inch wide and continuous length. Such traditional "full hard" steel banding is available from Steelscape, A BlueScope Steel Company, Kalama, Wash. as ZINCALUME® Steel Grade 80 (Class 1).

Representative properties of such Grade 80 (Class 1 banding, 0.023 inch thick, from Steelscape are as follows:

Yield strength—100.1 ksi average, 919-104.1 ksi range

Tensile strength—102.2 ksi average, 95.4-105.3 ksi range

Elongation in 2 inch sample—10% average, 9.6-10.3% range

Hardness, Rockwell B Scale—93.4 average, 92-95 range

"Ksi" means "thousands of pounds per square inch".

It is known that, when a fall protection system of the prior art, using 0.023 inch Grade 80 banding, 1 inch wide, is tested using the government-mandated test procedure, even if the system successfully passes the test, namely catches and holds the falling object, the suspension fabric tears at the screws which fasten the fabric and bands to the purlins. Typically, the longitudinal banding, and sometimes the lateral banding, closest to the falling object, also breaks.

As a corrective measure, some commercially available alleged fall protection systems require the use of two Tek screws, at least two inches apart, through the lateral banding and into the bottom flange of each respective eave. The purpose of the second screw is believed to be to provide additional strength to the attachment of the band to the eave, to prevent the band from tearing past the screws, or tearing the screw diagonally out the side of the band, when an object impacts the fall protection system fabric.

The determination of passing or failing the government-defined drop test is whether the falling object proceeds through the fabric, known as a test failure, or is successfully held and supported by the fabric, which is a successful, passing of the test.

The inventor herein has discovered, by his experience, by his testing, that existing commercially available alleged fall protection systems, even those using the two-screw attachment, fail the government-defined drop test when the force is applied adjacent a rafter, or anywhere the impact is passed directly to fewer than 4 bands surrounding the point of impact. Accordingly, the invention contemplates novel lateral bands.

Known fall protection systems specify that each lateral band be attached by a Tek screw to the bottom flange of each intermediate purlin, whereby a substantial fraction of the force of a worker falling, or the force of a drop test, is transferred through the respective lateral bands to the next adjacent purlins and to any adjacent rafter.

Where the force of a drop/impact/fall is applied at the lateral band which is next-adjacent a rafter, that force may be transferred by a single one of such lateral bands, in addition to the affected longitudinal band, to the building structural roof members.

Figure 5:
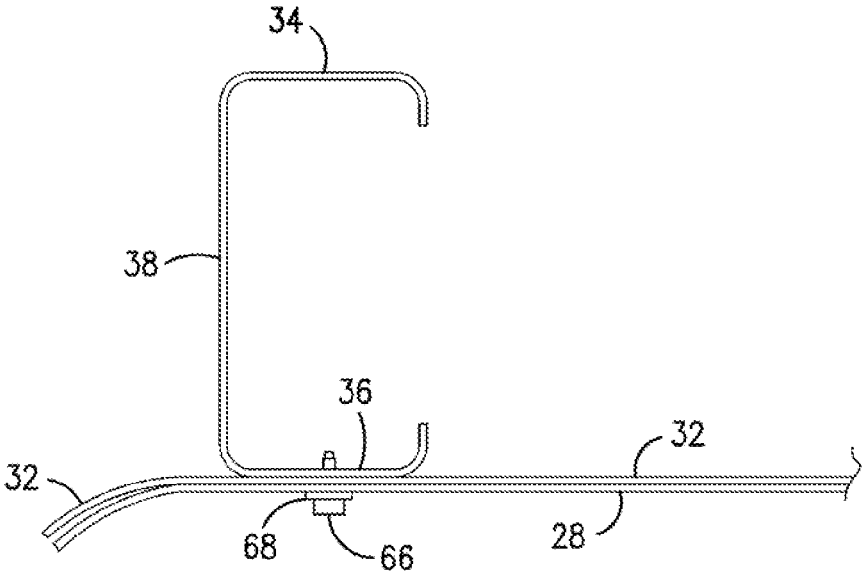
FIG. 5 is an edge view showing a lateral band fastened, attached, to the bottom flange of the eave.
Figure 6:
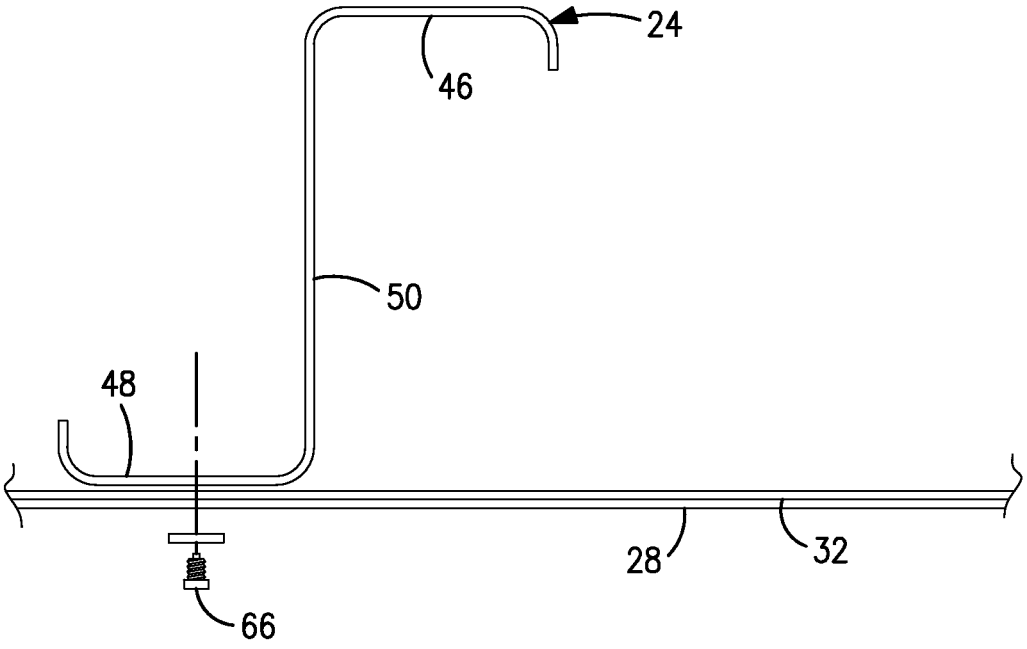
FIG. 6 is a cross-section of an intermediate purlin, and a Tek screw, with washer, positioned to extend the screw through the fabric and into the purlin bottom flange.

FIG. 5 shows the attachment of a lateral band to an eave 20 using a standard Tek screw. FIG. 6 shows the impending attachment of the lateral band to an intermediate purlin using a standard Tek screw.

Figure 7:
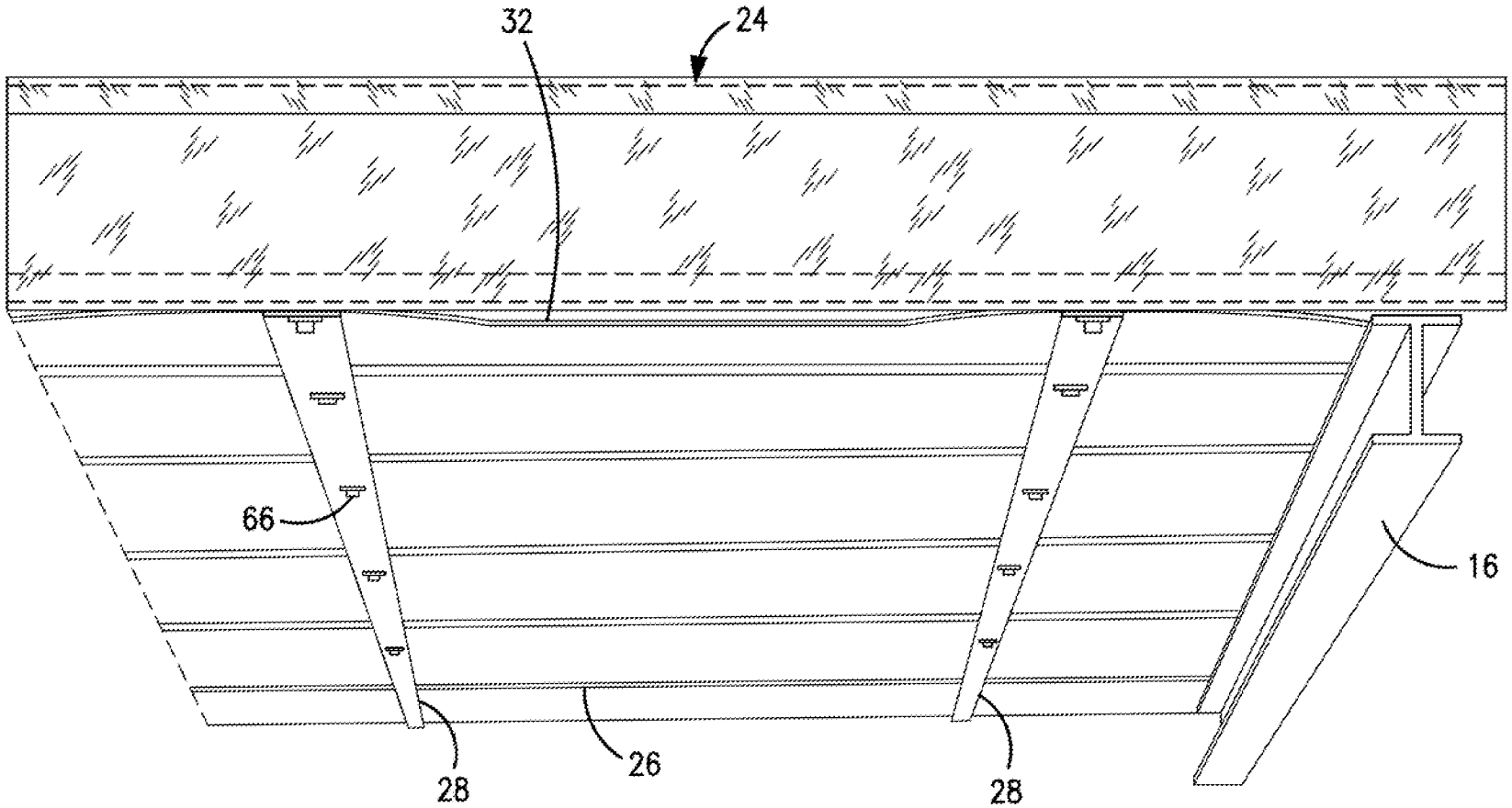
FIG. 7 is a perspective view from below a fall protection system of the invention, showing a purlin mounted on one of the rafters, also showing the lateral bands and the longitudinal bands collectively supporting the suspension fabric across a bay.

FIG. 7 illustrates that longitudinal bands 26 are supported by lateral bands 28, in that the tightened lateral bands underlie the longitudinal bands. Referring again to FIGS. 2 and 3, it is seen again that the longitudinal bands are secured against longitudinal movement only at rafters 16.

A distinctive feature of this invention is that the banding stock used for at east some of the lateral bands 28 is relatively softer and more yielding than banding stock which is traditionally used for bands 26 and 28, though the physical dimensions of such bands remain generally the same in the invention, at 1 inch width, and 0.023 inch thickness. Such softer banding stock used for a respective lateral band 28 has Yield strength, average—45-85 ksi, optionally 45-75 ksi, optionally 50-65 ksi, optionally 55-60 ksi Tensile strength, average—60-90 ksi, optionally 65-85 ksi, optionally 65-79 ksi, optionally 70-75 ksi Elongation in 2 inch sample—12%-40%, optionally 22%-37%

Hardness, Rockwell B Scale—50-80, optionally 60-79, optionally 70-75.

Yield, tensile and elongation properties are determined using an Instron Tensile Tester according to ASTM A370-12a. Briefly, a two-inches-long section of a dog-bone shaped sample is placed in the jaws of the test machine, and stretched by the machine until the sample breaks. Yield and ultimate tensile are recorded by the testing machine. Elongation is measured manually according to the test procedure after the sample breaks.

Banding material illustrated for use as the safety bands in this invention is available as a hot-dip zinc/aluminum alloy-coated Grade 50 structural steel, from Steelscape, A BlueScope Steel Company, Kalama, Wash. as ZINCALUME® Steel Grade 50 (Class 1).

Choosing to not be bound by theory, the inventor herein contemplates that the softer steel banding absorbs more of the force, and especially the shock effect of the impact, than the harder Grade 80 steel, while being strong enough to provide the needed support of fabric 32 and to transfer a remainder portion of the force of a dropping object to structural roof members of the building. Thus, while the prior art attempts to use the strength of the steel banding to transfer a portion of the force of the impact of the falling load to the roof structural members, in the invention, and at that lateral band which receives the greatest stress when participating in catching a falling load, which is that band next-adjacent the rafter, the invention relies on the elongation properties of the softer banding used for that lateral band to absorb more of the force of the impact as such softer band elongates to a greater degree than the known Grade 80 banding.

In light of the benefits provided by using the softer banding material for the lateral bands 28, the invention provides novel dissipation of the force of impact. Accordingly, the novelty in the invention can be extended such that, the remaining bands, including the remaining lateral bands 28 and the longitudinal bands 26, use the same softer steel banding.

Thus, in a first set of embodiments of the invention, the softer steel banding material is used in only the lateral band closest to the rafters while a relatively harder e.g. the full hard, banding material is used in the remaining lateral bands and in the longitudinal bands. This first option focuses attention on that lateral band which has the greatest likelihood of having to absorb and transfer all, or almost all, of the force which gets transferred to the purlins adjacent the impact site.

In a second set of embodiments of the invention, the softer steel banding material is used in all of the lateral bands while a relatively harder, e.g. full hard, banding material is used in all of the longitudinal bands. This second option focuses attention on the relatively shorter length distance between attachments of the lateral bands to the purlins, whereby relatively shorter lengths of lateral band, compared to relatively longer lengths of longitudinal banding, are tasked with absorbing and transferring impact forces to their next adjacent roof structural elements. Namely, the lateral banding transfers impact force to the next adjacent purlins, which are e.g. 5 feet apart. Thus, the lengths of the lateral bands which transfer impact force to roof structural members are typically about 5 feet.

By contrast, the longitudinal bands are anchored to the roof structure only at the rafters, which are commonly 25 feet apart. Thus, the lengths of the longitudinal bands which transfer the impact force to roof structural members are typically about 25 feet, about 5 times longer than the transfer portions of the lateral bands.

In a third set of embodiments of the invention, the relatively softer Grade 50 banding material is used in all of the longitudinal bands and all of the lateral bands. This third set of embodiments takes full advantage of the relatively greater elongation properties of the Grade 50 banding, to permanently elongate, while effectively passing, to the roof structural members, enough of the remainder portion of the impact force of the falling object that suspension fabric 32 is able to dissipate the remainder of the impact force without catastrophic failure of the fabric.

Banding used in the invention is distinguished from steel bar stock in that steel bar stock is stiff and rigid. By contrast, the banding used in the invention is thin and flexible such that the banding is typically shipped to the user in rolls. When the banding stock is cut to the e.g. specified 1-inch width, and the resulting bands are loosely draped over rafters spaced e.g. 25 feet apart, mid-sections of the bands readily drape downwardly by multiple feet from the elevations of the rafters. Further, such banding is completely incapable of supporting itself or the overlying suspension fabric, across the length and width of a typical bay, until substantial tensile force, which can be manually applied using hand tools, is applied to the banding.

Certain fabrics are known in the art for use as suspension fabrics in roof insulation systems, and such fabrics may be acceptable in the fall protection systems of the invention, provided that the bands used in the band grid-work of the invention are sufficiently close together. An exemplary fabric, which the inventor has tested and found satisfactory for use with the band grid-work disclosed herein is available as Type 1070 Vapor Retarder fabric from Intertape Polymer Group. Bradenton, Fla. The Type 1070 fabric is a woven HDPE scrim having the following characteristics as specified by the fabric supplier:

Nominal thickness—9 mils (0.23 mm)
Nominal weight—4.3 oz/yd$^2$ (149 g/m$^2$)
Grab Tensile—Warp 136 lb (605 N)/Weft 126 lb (559 N)
Strip Tensile—Warp 100 lb/in (877)/Weft 90 lb/in (799)
Tongue Tear—Warp 50 lb (222N)/Weft 45 lb (200 N)
Mullen Burst—245 psi (1690 kPa)
Moisture vapor transmission—0.02 perms.

A typical bay 18 is about 25 feet wide, between pairs of next-adjacent rafters. Within a given bay, lateral bands 28 extend parallel to each other, parallel to the respective rafters which define the bay, and are generally spaced apart by about 36 inches to 40 inches, but no more than 48 inches. Thus, a desired spacing between lateral bands 28 is 36-40 inches; but up to 48 inches is accepted where the increase from 40 inches e.g. up to 48 inches can reduce the number of bands.

A leading edge of fabric 32 can be placed inside the cave. A leading edge of the fabric enters the cave above bottom flange 36, passes across the top of the bottom flange to web 38, passes along the inside surface of web 38 and up to upper flange 34 and thence toward the ridge to the cave opening which faces the ridge. By traversing such path inside the cavity defined inside the eave, the fabric can substantially encase the edge of any insulation which is to be installed on top of the fabric in the space between the eave and the next-adjacent purlin.

In the alternative, the edge of the fabric, at the eave, can be trapped between the lateral banding and the lower surface of the bottom flange of the cave as suggested in FIGS. 3 and 5.

If/When a falling/dropping impact force arrives on the suspension fabric, the force received by the suspension fabric has a first directional force component and a second velocity/shock/suddenness component. The force component of the impact is resisted by, absorbed by, the deflection characteristics of the materials in the fall protection system. The velocity/shock/suddenness component of the impact addresses the rate at which the respective materials can deflect as the force of the impact is applied to the respective building elements.

Where a given lateral band 28 is one of the closest lateral bands to the point where the impact force is received, a first portion of that force, which is received at the fall protection system, is transferred, as first tensile forces, into the respective lateral band and is absorbed, dissipated, at least in part, by tensile elongation of the respective lateral band.

A second portion of that received force is transferred, by the lateral band to the next-adjacent purlins which are closest to the location of the impact.

A third portion of that force is received into the respective longitudinal band, or bands, and is absorbed, dissipated, at least in part, by tensile elongation a the respective longitudinal band or bands.

A fourth portion of that received force is received by the respective longitudinal band or bands, and transferred by the longitudinal bands, to the respective rafters 16.

A fifth portion of that received force is distributed about the respective affected area of the suspension fabric. While choosing to not be bound by theory, the inventor herein contemplates that the fabric absorbs both a portion of the directional component of the force of the impact and a velocity/shock/suddenness component of the force of the impact.

Turning again to the responses of the bands, the tensile forces so imposed on the longitudinal bands and the respective lateral band or bands are distributed along the full lengths of the respective longitudinal bands and along that portion of the respective lateral band or bands which is/are between the two purlins which are next adjacent the location on the fall protection system where the impact of the drop is received. Thus, the elongation properties of both the longitudinal bands and the lateral bands are utilized in transferring portions of the impact force to the roof structural elements, namely one or more intermediate purlins, and optionally to ridges or eaves, and to the rafters.

FIG. 7 further shows, in its typical configuration of the fall protection system of the invention, that lateral bands 28 can, and commonly are, attached to each purlin in a conventional manner, namely by screwing a Tek screw 66, with accompanying washer, through a hole in the lateral band, thence through the suspension fabric, and thence through the lower flange of the respective purlin. The suspension fabric is thus trapped between the lower flange of the purlin and the respective washer/screw combination, which tightly clamps the suspension fabric to the lower surface of the lower flange of the purlin.

METHOD

Installation of a fail protection system of the invention begins after the columns, rafters, ridges, eaves, and intermediate purlins are in place about at least a given bay. Typically, installation of the fall protection system begins after erection/emplacement of all of the columns, rafters, ridges, eaves, and purlins.

Installation of the fall protection system begins by installing longitudinal bands 26. A given longitudinal band is installed by unwinding band material from a roll and extending the band material over the tops of the respective rafters and across a given bay or bays. At least one longitudinal band is extended, between each next-adjacent pair of purlins to at least the next rafter, and is cut to length. The longitudinal bands are manually stretched tight with hand tools, and the so-tightened bands are fastened to the respective rafters with Tek screws. As illustrated in the drawings, the longitudinal bands typically extend perpendicular to the rafters. The so-partially-installed, tightened, longitudinal bands extend from rafter to rafter at generally the height of the tops of the rafters, but some nominal amount of sag of the longitudinal bands exists between the rafters at this stage of installation.

Typically, the purlins are spaced no more than 5 feet apart. In this invention, typically a single band is installed between each pair of next-adjacent purlins so long as the purlin spacing is no more than the typical maximum of 5 feet. Where the purlin spacing approaches, or exceeds, the typical 5-feet maximum, an additional longitudinal band 26 may be used in one or more of the spaces between the purlins.

Once the longitudinal bands 26 have been emplaced and tightened, banding for lateral bands 28 is unrolled under the longitudinal bands, and one end of the banding is secured to the respective ridge or purlin, or to an opposing eave. The lateral banding material is extended to the eave of the respective bay and then tightened sufficiently to raise both the lateral band and the overlying longitudinal bands into close proximity with the intermediate purlins. This process is repeated along the width of the bay, e.g. between the rafters, until the desired number of lateral bands has been emplaced across the width of the bay.

With the band grid system thus temporarily in place, a zigzag-folded roll of the suspension fabric is elevated to the height of the rafters, typically adjacent a rafter at an end of the building or bay. The fabric is then unrolled on top of the band grid in one of the spaces between next-adjacent ones of the purlins such that one end of the fabric faces the eave and the opposing end of the fabric faces the ridge. The ends of the fabric are then pulled, individually, toward the eave and the ridge, working the leading ends of the fabric under the intervening intermediate purlins and above the band grid. The initial phase of the process of so-extending the fabric is illustrated in FIG. 3.

With the fabric having been generally extended the full length and width of the bay over which the fabric is to be suspended, namely over the band grid and under the intermediate purlins, the lateral bands are then attached to the intermediate purlins, one self-drilling Tek screw through each lateral band and the fabric, at each purlin, typically beginning at the ridge and working toward the eave. As a such Tek screw/washer is driven tight against the bottom surface of the fabric, the fabric is correspondingly driven tight against the bottom surface of the lower flange of the purlin. The fabric is thus tightly trapped between the washer and the lower flange of the purlin. Screws 66 are driven through each lateral band 28 at each purlin, fastening the lateral bands directly to the purlins as illustrated in FIG. 7.

Once the attachments to the intermediate purlins have been completed, the temporary attachments of the bands to the cave are released, and the lateral bands are permanently attached to the cave, e.g. using screws 66 driven through the lateral bands, e.g. as illustrated in FIG. 5.

Sides of the fabric are then cut around the purlins at each rafter, as known in the art, and edges of the fabric are secured to the top surfaces of the rafters such as by adhesive, also as known in the art.

With both the longitudinal and lateral bands so secured to the roof structure; with the fabric so secured to the ridge and cave by the lateral bands and secured to the rafters by e.g. adhesive, installation of the fall protection system of the invention is thus complete and ready to protect workers who subsequently install other elements of the building while working at the roof elevation; such elements as the roof insulation and the roof panels.

Suspension fabric 32, which in the preferred embodiment consists of a vapor barrier material, is trimmed to size before installation. The suspension fabric is installed one bay 18 at a time and, in the case of large buildings or buildings with high gables, fabric 32 for each half of the bay may be divided at ridge 22 and may be installed separately.

The suspension fabric has been cut, prior to installation, to a size having a dimension a few inches longer, at each side and each end, than the dimensions of the bay to be overlaid, and is Z-folded for easy spreading above the band grid. For this purpose a zigzag type fold, as shown in FIG. 3, is easiest to work with, although other rolling or folding arrangements can also be used and are within the scope of the invention.

The fall protection systems of the invention are designed to be of sufficient strength to catch and support a man's weight, generally between 250 and 400 pounds. The system is tested by dropping a 400 lb. weight with the center of gravity of the weight, before the weight is dropped, being 42 inches above a worker's walking height, thus 42 inches plus the height of the purlins, namely about 50.5 inches above the fabric. To pass the test, the system must stop the falling weight at any point in the bay which is so protected. In one test specified by OSHA, 400 lb. of washed gravel or sand is placed into a reinforced bag that can tolerate being dropped repeatedly. The test bag is 30 inches in diameter. The 400 pound bag is hoisted above the fall protection system to a height of 42 inches above the plane of the intermediate purlins, measuring from the center of the so-filled bag. A cord supporting the weight of the bag is then released, allowing the weight to free fall in one concentrated load. The weight can be dropped onto any part of the fall protection system to test different areas.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A fall protection system in a building roof structure, such building roof structure including structural roof elements which include at least first and second rafters, a space between said first and second rafters defining a first distance between said first and second rafters, each said rafter having a length, a top, and opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, extending transverse to, and being connected to, the tops of said first and second rafters, and a plurality of intermediate purlins extending between said first and second rafters and spaced from each other between said eave and said ridge, said intermediate purlins being disposed on, and extending transverse to, the tops of said first and second rafters, said fall protection system comprising:

(a) a first set of longitudinal support bands extending from said first rafter to said second rafter and being connected to said building structural roof elements, said first set of longitudinal support bands being spaced along the lengths of said first and second rafters;

(b) a second set of lateral support bands extending from said eave toward said ridge and under said intermediate purlins, said bands of said second set of support bands having first and second end portions which are spaced along the lengths of said eave and said ridge; and (c) a suspension fabric overlying, and being supported by, said first and second sets of support bands, and being attached to said building structural roof elements, said first and second sets of support bands collectively defining a grid-work of crossing bands, a first band of said second set of lateral support bands having at least one of (i) a first yield strength, or (ii) a first tensile strength, or (iii) a first elongation, at least a second band, of said first set of longitudinal support bands, having at least one of (iv) a yield strength greater than the first yield strength, or (v) a tensile strength greater than the first tensile strength, or (vi) an elongation less than the first elongation.

2. A fall protection system as in claim 1, said first band having at least one of (i) a yield strength of 45 ksi to 85 ksi, or (ii) a tensile strength of 60 ksi to 90 ksi, or (iii) an elongation of 12 percent to 40 percent.

3. A fall protection system as in claim 2, said first band having a hardness of 55 Rockwell B to 80 Rockwell B.

4. A fall protection system as in claim 2, said first band comprising a safety band, said grid work of crossing bands comprising a said safety band next adjacent each side of each rafter in any portion of said building roof structure where said grid-work of crossing bands supports said suspension fabric.

5. A fall protection system as in claim 2, said suspension fabric extending, as a generally flat sheet, across an open expanse bounded by said first rafter, said ridge, said second rafter, and said eave, said suspension fabric being supported by said first and second sets of bands and being restrained against movement along such structural roof elements by attachments of said suspension fabric to said first and second rafters, to said eave proximate a first end of said suspension fabric and to another one of such structural roof elements proximate a second opposing end of said suspension fabric.

6. A fall protection system as in claim 1, said first band having (i) a yield strength of 45 ksi to 75 ksi, and (ii) a tensile strength of 65 ksi to 85 ksi, and (iii) an elongation of 22 percent to 37 percent, and (iv) Rockwell B hardness of 50 to 80.

7. A fall protection system as in claim 6, said fall protection system being of sufficient strength to catch and support a weight of 400 pounds, distributed over a diameter of approximately 30 inches, when dropped from a height of about 50.5 inches.

8. A fall protection system as in claim 1, said first band having a hardness of 50 Rockwell B to 85 Rockwell B.

9. A fall protection system as in claim 1, said first band having a hardness of 64 Rockwell B to 79 Rockwell B.

10. A fall protection system as in claim 1 wherein each of said lateral support bands has (i) a yield strength of 45 ksi to 85 ksi, and (ii) a tensile strength of 60 ksi to 90 ksi, and (iii) an elongation of 12 percent to 40 percent.

11. A fall protection system as in claim 1 wherein each of said longitudinal support bands has at least one of (i) a yield strength greater than the first yield strength, and (ii) a tensile strength greater than the first tensile strength, and (iii) an elongation less than the first elongation.

12. A fall protection system as in claim 1, said first band being next adjacent said first rafter, a third band, of said second set of support bands, next adjacent said second rafter, having at least one of the first yield strength, or the first tensile strength, or the first elongation.

13. A fall protection system as in claim 1, each of said longitudinal support bands having at least one of
yield strength greater than the first yield strength, or
tensile strength greater than the first tensile strength, or
elongation less than the first elongation.

14. A fall protection system as in claim 1, a third band, of said second set of support bands having at least one of
a yield strength greater than the first yield strength, or
a tensile strength greater than the first tensile strength, or
an elongation less than the first elongation.

15. A fall protection system as in claim 1, each band in said second set of support bands having at least one of
a yield strength less than the yield strength of said second band, or
a tensile strength less than the tensile strength of said second band, or
an elongation greater than the elongation of said second band.

16. A fall protection system s in claim 15 wherein each longitudinal band has at least one of
a yield strength greater than the first yield strength, or
a tensile strength greater than the first tensile strength, or
an elongation less than the first elongation.

17. A fall protection system as in claim 1, a third band of said second set of support bands having at least one of
the first yield strength, or
the first tensile strength, or
the first elongation.

18. A fall protection system in a building roof structure, such building roof structure including structural roof elements which include at least first and second rafters, a space between said first and second rafters defining a first distance between said first and second rafters, each said rafter having a length, a top, and opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, extending transverse to, and being connected to, the tops of said first and second rafters, and a plurality of intermediate purlins extending between said first and second rafters and spaced from each other between said cave and said ridge, said intermediate purlins being disposed on, and extending transverse to, the tops of said first and second rafters, said fall protection system comprising:
(a) a first set of longitudinal support bands extending from said first rafter to said second rafter and being connected to said building structural roof elements, said first set of longitudinal support bands being spaced along the lengths of said first and second rafters;
(b) a second set of lateral support bands extending from said eave toward said ridge and under said intermediate purlins, said bands of said second set of support bands having first and second end portions which are spaced along the lengths of said cave and said ridge; and
(c) a suspension fabric overlying, and being supported by, said first and second sets of support bands, and being attached to said building structural roof elements,
said first and second sets of support bands collectively defining a grid-work of crossing bands,
each band of said second set of lateral support bands having at east one of
(i) a yield strength of 45 ksi to 85 ksi, or
(ii) a tensile strength of 60 ksi to 90 ksi, or
(iii) an elongation of 12 percent to 40 percent,
at least a first band of said first set of longitudinal support bands having at least one of
(iv) a yield strength greater than the yield strength of a first said band in said second set of support bands, or
(v) a tensile strength greater than the tensile strength of a first said band in said second set of support bands, or
(vi) an elongation less than the elongation of a first said band in said second set of support bands.

19. A fall protection system as in claim 18 wherein all of said bands in said first set of longitudinal support bands have at least one of
yield strength greater than the yield strength of a first said band in said second set of support bands, or
tensile strength greater than the yield strength of a first said band in said second set of support bands, or
elongation less than the elongation of a first said band in said second set of support bands.

20. A fall protection system as in claim 18, a first aid band in said second set of lateral support bands having
a yield strength of 65 ksi to 75 ksi, and
a tensile strength of 65 ksi to 85 ksi, and
an elongation of 22 percent to 37 percent.

21. A fall protection system in a building roof structure, such building roof structure including structural roof elements which include at least first and second rafters, a first distance between said first and second rafters, each said rafter having a length, a top, and opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, extending transverse to, and being connected to, the tops of said first and second rafters, and a plurality of intermediate purlins extending between said first and second rafters and spaced from each other between said eave and said ridge, said intermediate purlins being disposed on, and extending transverse to, the tops of said first and second rafters, said fall protection system comprising:
(a) a first set of longitudinal support bands extending from said first rafter to said second rafter and being connected to said building structural roof elements, said first set of longitudinal support bands being spaced along the lengths of said first and second rafters;
(b) a second set of lateral support bands extending from said eave toward said ridge and under said intermediate purlins, said bands of said second set of support bands having first and second end portions which are spaced along the lengths of said eave and said ridge; and
(c) a suspension fabric overlying, and being supported by, said first and second sets of support bands, and being attached to said building structural roof elements,
said first and second sets of support bands collectively defining a grid-work of crossing bands,
a first band of said second set of lateral support bands having at least one of
(i) a first yield strength,
(ii) a first tensile strength, and
(iii) a first elongation,
at least a second band, of said second set of lateral support bands, having at least one of
(iv) a yield strength greater than the first yield strength, or
(v) a tensile strength greater than the first tensile strength or
(vi) an elongation less than the first elongation.

22. A fall protection system as in claim 21 wherein at least a third band in said first set of bands has at least one of
a yield strength greater than the first yield strength, or a tensile strength greater than the first tensile strength, or an elongation less than the first elongation.

23. A fall protection system as in claim 21, said first band being next adjacent said first rafter, a third band, of said second set of support bands, next adjacent said second rafter, having at least one of the first yield strength, or the first tensile strength, or the first elongation.

* * * * *